US006116251A

United States Patent [19]

Stachowski

[11] Patent Number: 6,116,251

[45] Date of Patent: Sep. 12, 2000

[54] SPRING STRIP HAIR CLIP

[76] Inventor: Barbara C. Stachowski, 11 E1 Gavilan, Orinda, Calif. 94563

[21] Appl. No.: 09/172,093

[22] Filed: Oct. 13, 1998

[51] Int. Cl.[7] ..... A45D 8/14

[52] U.S. Cl. ..... 132/273; 132/276

[58] Field of Search ..... 132/273, 245, 132/246, 247, 275, 55, 276, 277, 279, 280, 284; 63/3, 5.1, 11, 6

[56] References Cited

U.S. PATENT DOCUMENTS

| | | | |
|---|---|---|---|
| 1,512,490 | 10/1924 | Scheanblum et al. | 132/246 |
| 2,066,709 | 1/1937 | Adams | 132/246 |
| 2,262,478 | 11/1941 | Thompson et al. | 132/55 |
| 2,720,207 | 10/1955 | Burtnett | 132/246 |
| 3,410,023 | 11/1968 | Anello | 63/11 |
| 3,915,203 | 10/1975 | Solomon | 140/87 |
| 5,499,638 | 3/1996 | Ripley | 132/246 |
| 5,833,335 | 11/1998 | Voughlohn | 132/273 |
| 5,857,217 | 1/1999 | Hsueh | 2/170 |

FOREIGN PATENT DOCUMENTS

| | | | |
|---|---|---|---|
| 797281 | 4/1936 | France | 132/273 |

*Primary Examiner*—Todd E. Manahan
*Assistant Examiner*—Eduardo C. Robert
*Attorney, Agent, or Firm*—Lumen Intellectual Property Services

[57] ABSTRACT

A hair styling article comprises a spring strip having an open state and a closed state. In the open state the strip has a linear shape and high energy, while in the closed state it has a coiled shape and a low energy. The article also comprises a second strip which is flexible and approximately equal in length to the spring strip. The second strip is preferably a spring strip also. A method of styling hair using the article comprises placing a portion of the hair between the two strips while the strips are in their open states and then coiling them such that they release energy and enter low energy states corresponding to a coiled shape. In a preferred embodiment, the article comprises two strips of carbon spring steel flexibly attached to each other at one end and coated with a material having a textured surface to help prevent hair from slipping.

18 Claims, 13 Drawing Sheets

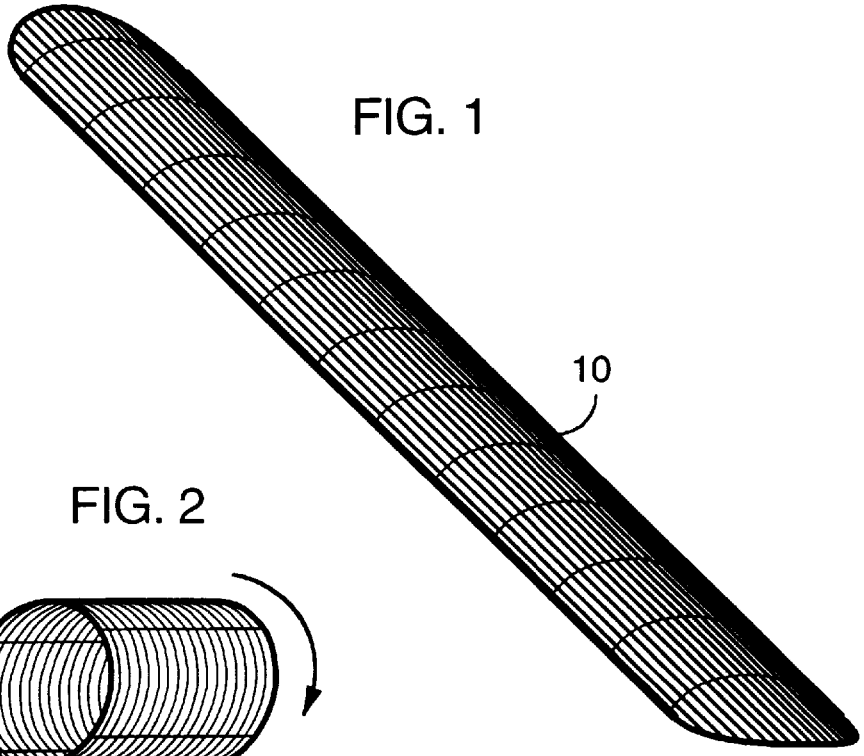
FIG. 1
FIG. 2
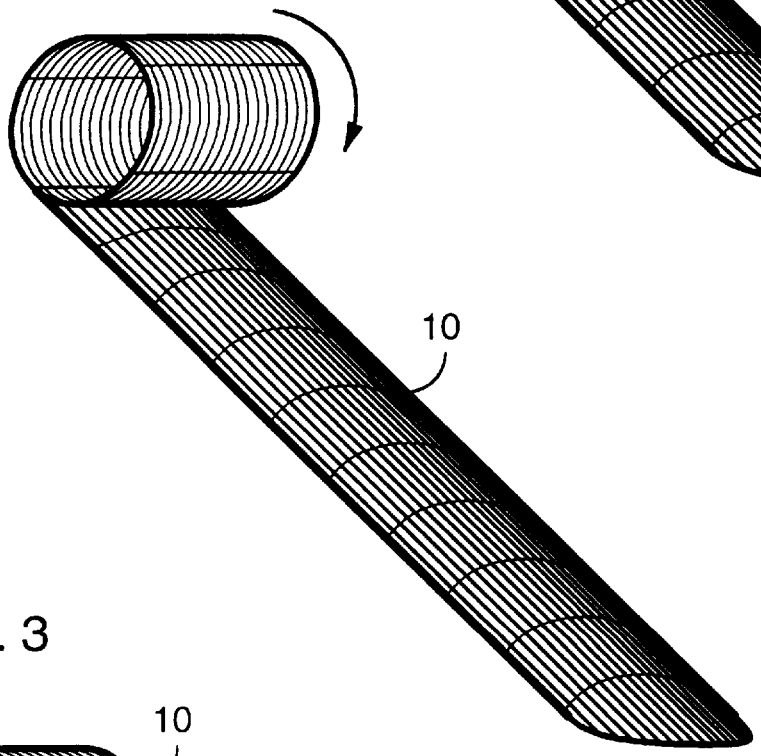
FIG. 3
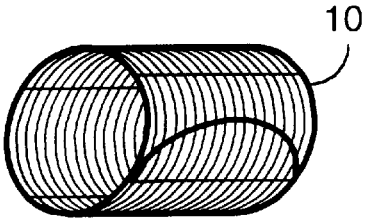

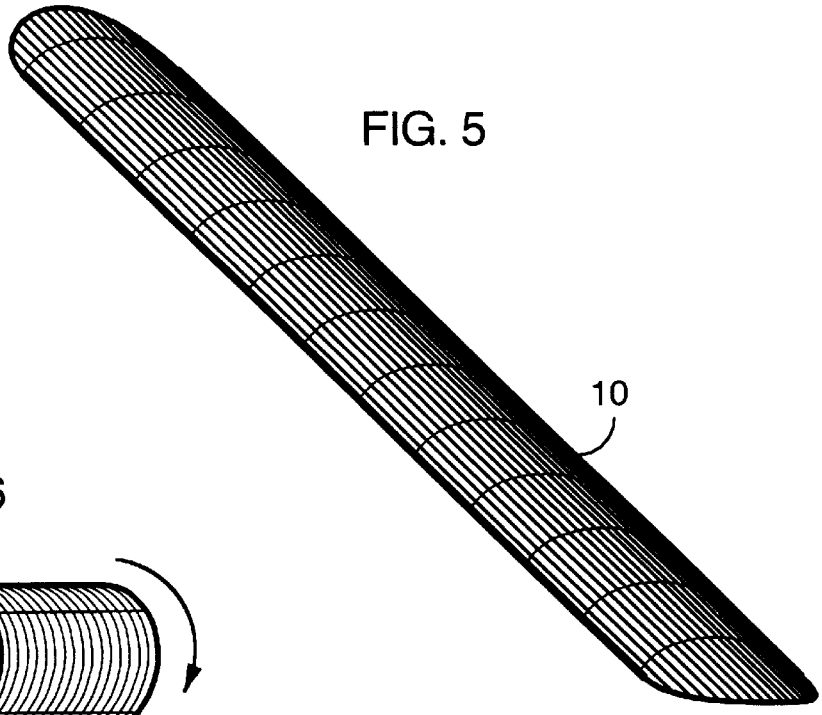
FIG. 5
FIG. 6
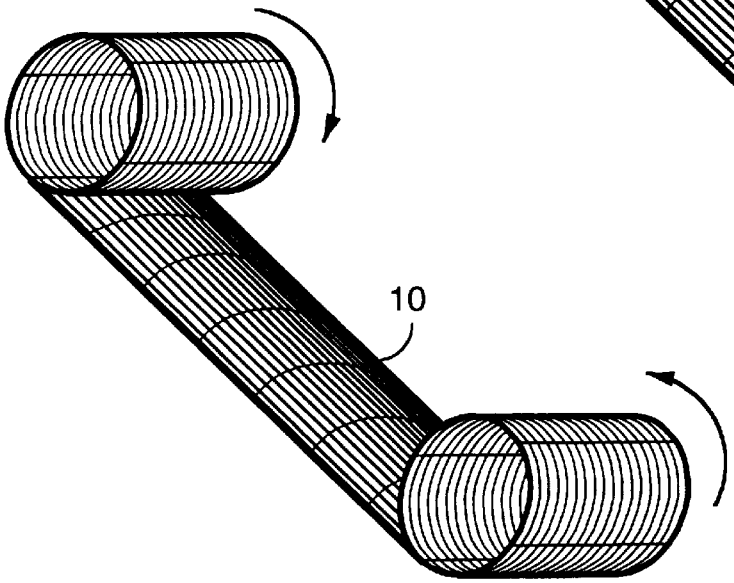
FIG. 7
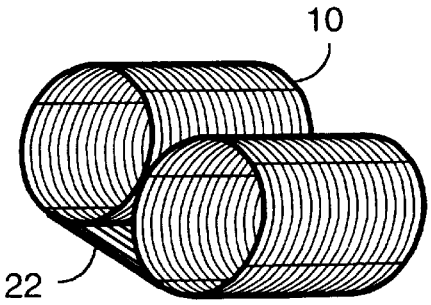

FIG. 11A
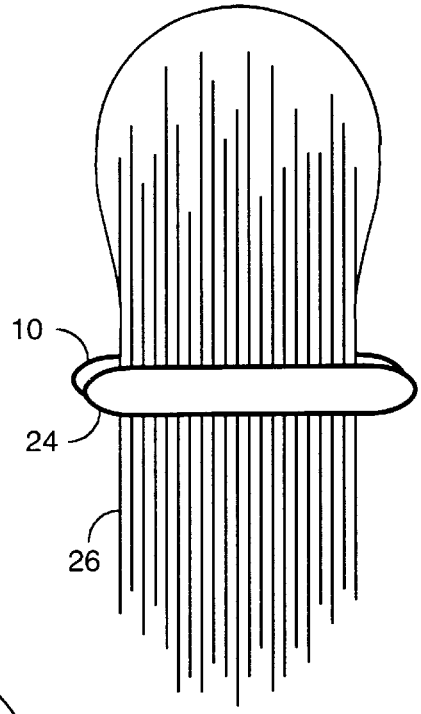
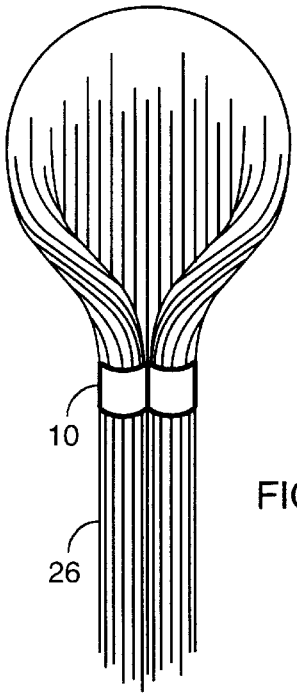
FIG. 11B
FIG. 11C
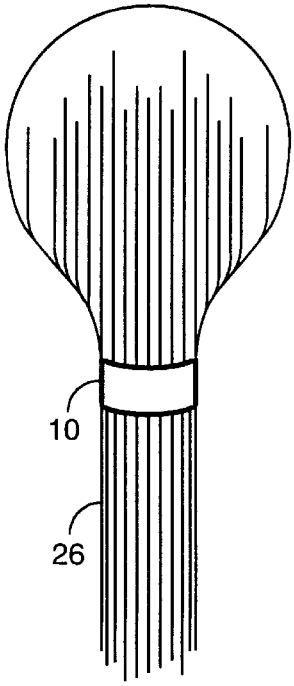

FIG. 17A
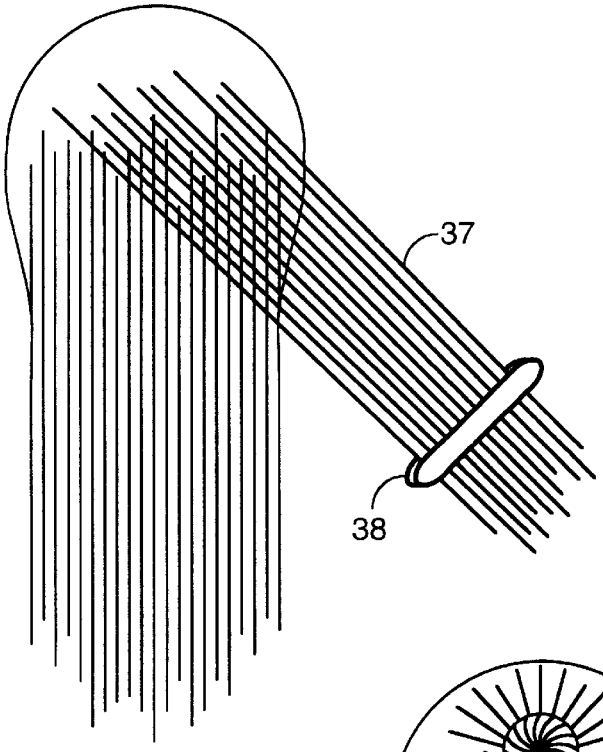
FIG. 17C
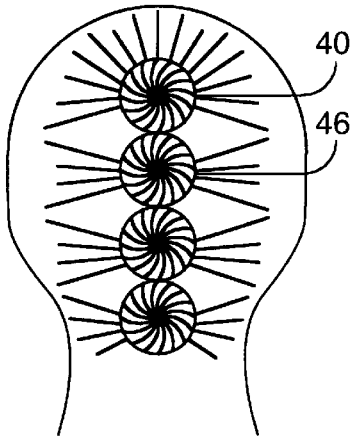
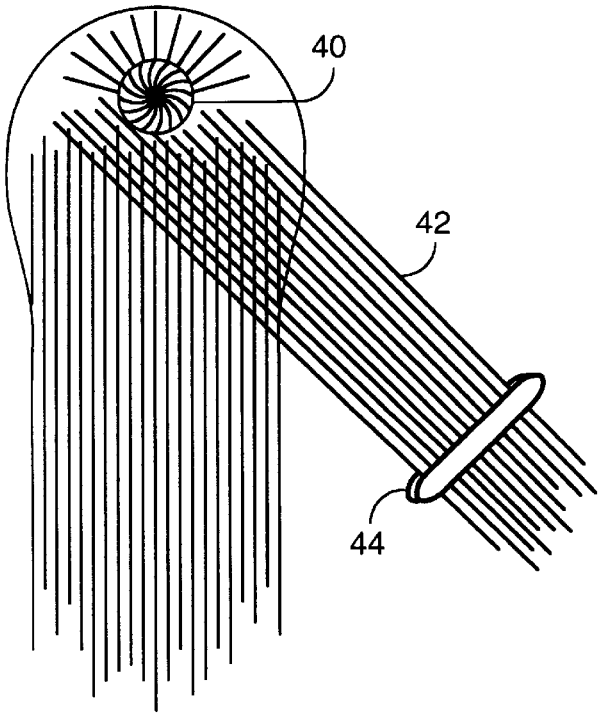
FIG. 17B

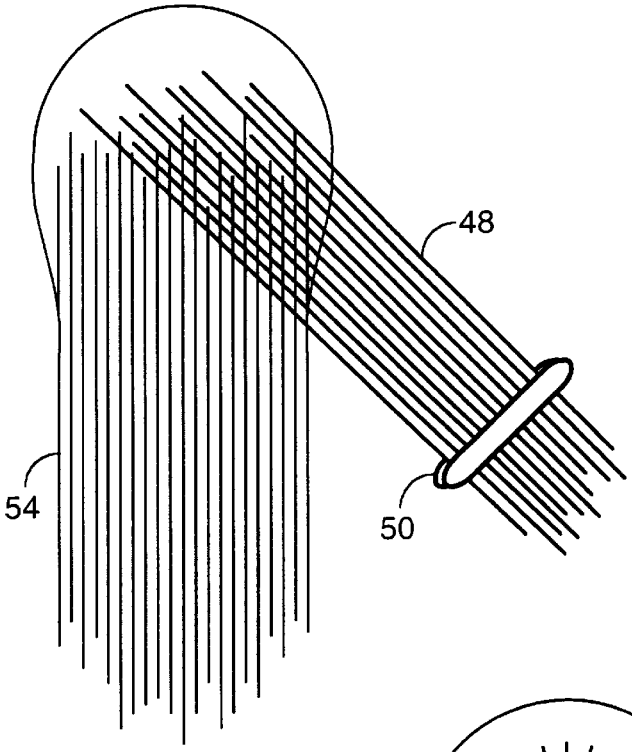
FIG. 18A
FIG. 18C
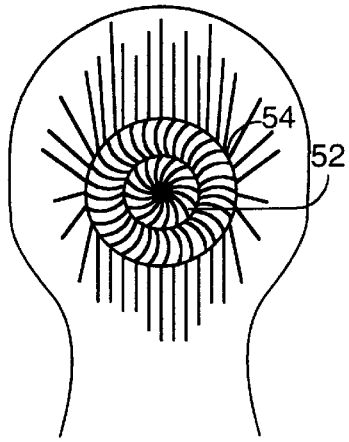
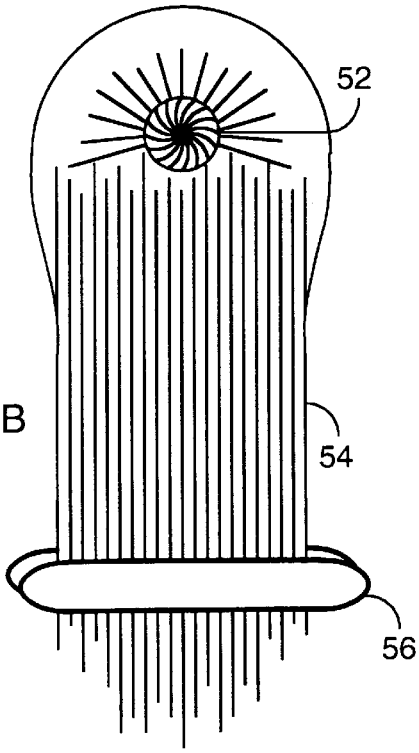
FIG. 18B

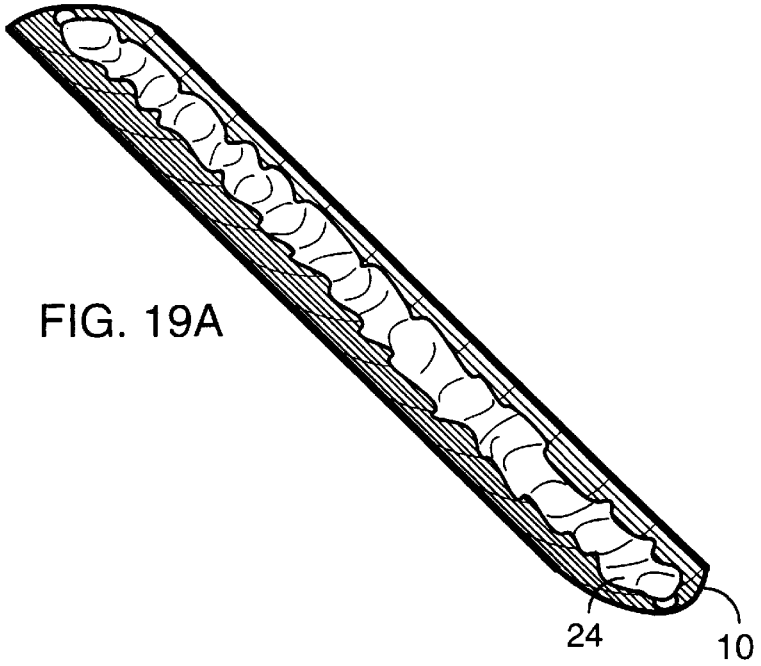
FIG. 19A
FIG. 19B
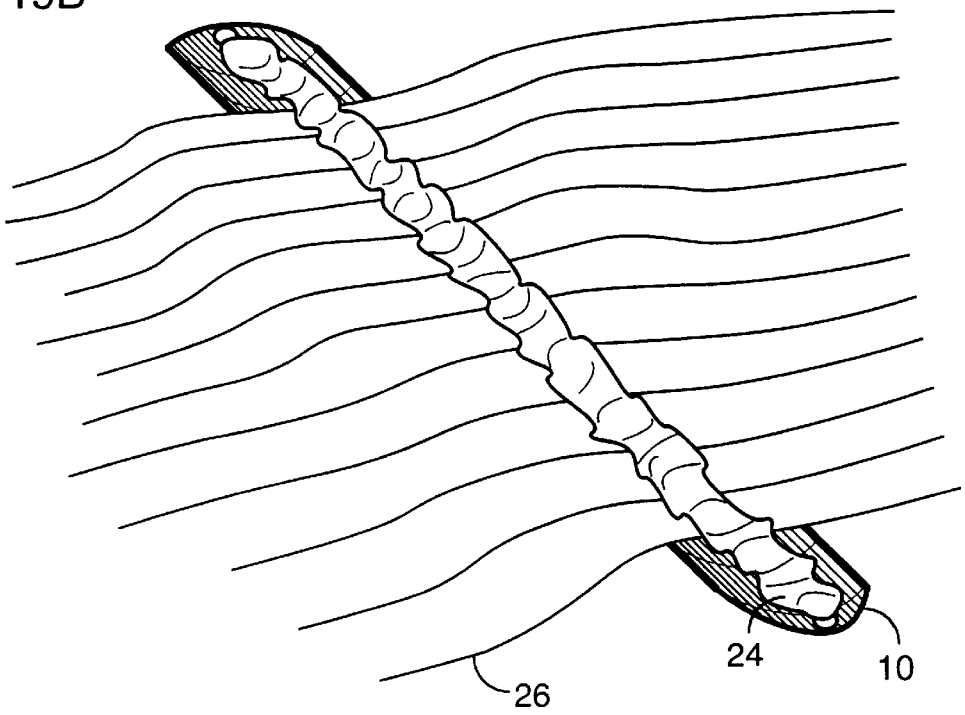

SPRING STRIP HAIR CLIP

FIELD OF THE INVENTION

This invention relates generally to articles for holding and styling hair. More particularly, it relates to hair clips comprising a springed strip.

BACKGROUND OF THE INVENTION

Known hair styling articles are typically composed of rigid materials and hinges. They are typically relatively complicated to assemble. Simpler hair styling articles are composed of stiff bendable wire or elastic material. These articles typically require force on the part of the user to fasten. A great disadvantage of all these hair styling articles, however, is that the number of hair styles they can be used to create is very limited. The prior art hair styling tools are style-specific; they either create pony tails or up-dos (referring to any style in which hair is lifted up and styled against the head), but not both. In addition, they are often clumsy to use, and the hair styles they can create are difficult to form. Also, many of the prior art hair styling articles easily break or wear out.

SUMMARY OF THE INVENTION

Accordingly, it is a primary object of the present invention to provide an article for holding and styling hair that is simple, versatile, easy to use, durable, inexpensive to manufacture, and capable of being used to create a wide variety of different hair styles. These objects and advantages are attained by a hair styling article comprising a spring strip having an open state and a closed state. In the open state the strip has a linear shape and high energy, while in the closed state it has a coiled shape and a low energy. The preferred article also comprises a second strip which is flexible and approximately equal in length to the spring strip. The second strip is preferably a spring strip also. A method of styling hair using the article comprises placing a portion of the hair between the two strips while the strips are in their open states and then coiling them such that they release energy and enter low energy states corresponding to a coiled shape. In a preferred embodiment, the article comprises two strips of carbon spring steel flexibly attached to each other at one end and coated with a material having a texture to help prevent hair from slipping. Rather than holding hair strands by simply compressing them together, as is typically done in the prior art, hair styling articles of the present invention style hair by trapping strands of hair between, and possibly around, two strips that, when released, spring into a closed, coiled state, taking the trapped hair strands with them. This dynamic styling process uses the coiling energy of the strips to actively style the hair. In contrast with prior art hair styling articles, the hair styling strips provided by the present invention can be used to easily create a great number of different hair styles including pony tails and up-dos. In addition to their versatility, the hair styling strips are durable and attractive.

DESCRIPTION OF THE FIGURES

FIG. 1 is a perspective view of a spring strip in an open, high energy state, according to the present invention.

FIG. 2 is a perspective view of a spring strip in an partly coiled, intermediate energy state, according to the present invention.

FIG. 3 is a perspective view of a spring strip in an closed, low energy state, according to the present invention.

FIG. 5 is a perspective view of a spring strip in an open, high energy state, according to the present invention.

FIG. 6 is a perspective view of a spring strip in an partly coiled, intermediate energy state, according to the present invention.

FIG. 7 is a perspective view of a spring strip in a closed, double-coiled state, according to the present invention.

FIGS. 11A–11C illustrate successive steps of creating two "ponytail" hair styles, according to the present invention.

FIGS. 17A–17C illustrate successive steps of creating a "French buttons" hair style, according to the present invention.

FIGS. 18A–18C illustrate successive steps of creating a "rose" hair style, according to the present invention.

FIGS. 19A–19B are perspective views of a pair of attached strips, according to the present invention.

DETAILED DESCRIPTION

Energetic Properties

A hair styling article according to a preferred embodiment of the present invention comprises a strip 10 of material having a continuum of mechanical energy states. As shown in FIG. 1, an "open" state of the strip is a stable state of equilibrium having high energy. In the open state the strip 10 is extended linearly in the longitudinal direction and has a slight curvature around the longitudinal axis. A "closed" or "coiled" state of the strip 10, shown in FIG. 3 is a stable state of equilibrium having low energy. In the closed state the strip is coiled or rolled up upon itself. Between these open and closed states is a continuum of unstable non-equilibrium states, most of which have energies intermediate between the energies of the open and closed states. A strip 10 in one such partly coiled state is shown in FIG. 2. In these intermediate energy states the strip is partly coiled and spontaneously releases its energy and moves toward more coiled states.

Figure 4:
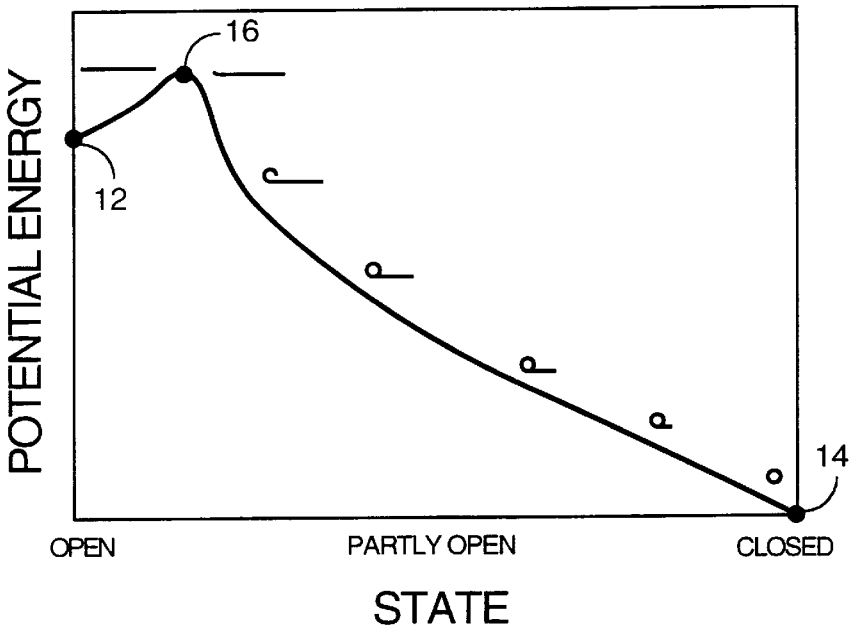
FIG. 4 is a graph of the spring strip energy vs. spring strip state, according to the present invention.

FIG. 4 is a graph illustrating the relationship between the mechanical potential energy of the strip 10 and its state. At the left side of the graph is the open state 12 of the strip, which has a high energy, while at the right side of the graph is the closed state 14 of the strip, which has a low energy. Near the open state is region of unstable states of energy slightly higher than that of the open state. Consequently, the open strip remains in the open state until it is pushed out of this equilibrium state and past the intermediate state characterized by the maximal amount of energy 16. The strip then spontaneously coils up and releases its energy until it arrives in the closed state 14 of lowest energy or is arrested in an intermediate state by an external restraining force. A closed or partly closed strip may be opened by forcibly uncoiling it. If the strip is pushed open past the highest energy state 16, then it spontaneously snaps into the open state of equilibrium.

Figure 8:
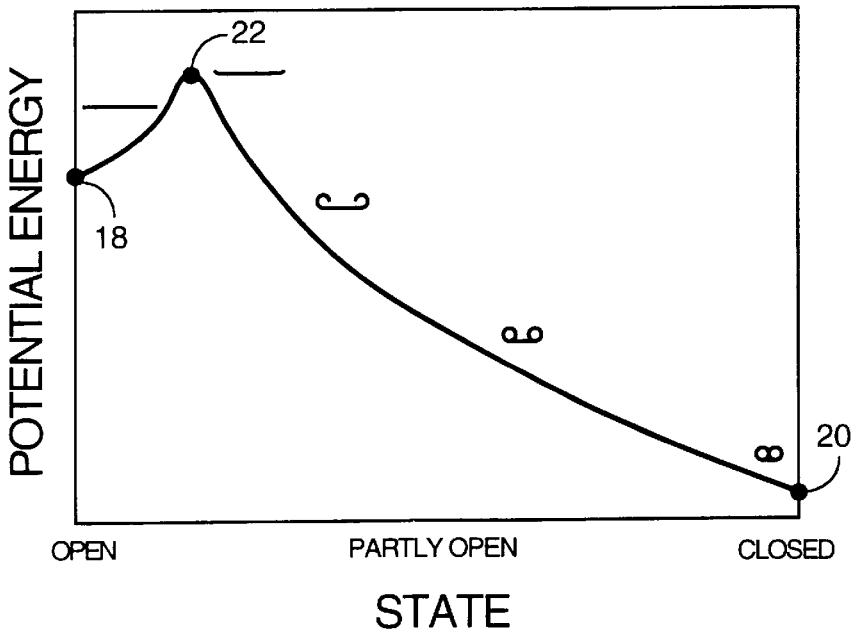
FIG. 8 is a graph of the spring strip energy vs. spring strip state, according to the present invention.

A strip 10 according to the present invention may coil up from one end to the other, as illustrated above in FIGS. 1, 2 and 3. Alternatively, the strip may coil up from both ends simultaneously, as shown in FIGS. 5, 6, and 7. FIG. 5 shows the strip in the open state, FIG. 6 shows the strip partly coiled from both ends, and FIG. 7 shows the strip in the closed state, or "double coiled" state. A graph illustrating the potential energy vs. state for a strip experiencing double coiling is shown in FIG. 8. The open state 18 is a high energy equilibrium state, just as before. The closed state 20 is again a low energy equilibrium state, but in this case its energy is slightly higher than the closed state 14 of the single-coiled strip (FIG. 4). This difference in energy is due to the fact that a portion 22 of the double coiled strip remains straight in the closed position. Thus, a portion of the potential energy of the double coiled strip remains unreleased. The highest energy state 22, like state 16 (FIG. 4), is the peak of an energy barrier that separates the open and closed states from each other. To open a closed strip, or close and open strip, the strip must be given sufficient activation energy to push the strip over this peak. Once pushed over the peak, the strip relaxes into the open or closed state.

Material Composition of Strips

Strips possessing the essential defining properties described above may be composed of any of various materials such as metal, plastic, or other suitable natural or synthetic compound or ferrous or non-ferrous laminate. In the preferred embodiment of the present invention, the strip is composed of carbon spring steel—a metal alloy treated by a well-known process of coiling, winding, and forming that results in a strip of steel having a slight arc centered around its longitudinal axis, and exhibiting the energetic properties described above. The process can be adapted to strips of various sizes and thicknesses, and can also be adapted to create strips having various properties such as different coiling radii and different coiling forces. In an alternative embodiment, the spring strip is composed of a stiff plastic material. Based on the guidance provided in the present description, those skilled in the art of materials engineering can select specific materials and processes to manufacture various types of spring strips appropriate for use in various embodiments of the hair styling article of the present invention.

Physical Dimensions of Strips

A hair styling article according to a preferred embodiment of the invention comprises a spring strip 10 measuring approximately 1 inch by 10 inches. As will be evident from the description below, however, a wide range of dimensions are possible and useful. For example, one useful embodiment of the invention employs a small spring strip measuring approximately ½ inch by 2 inches, while another embodiment uses a large spring strip measuring 3 inches by 24 inches. The size of the strip or strips used, as well as their other properties, will depend on the type of hair that is being styled, as well as on the type of the style, as will be described in detail below. Accordingly, a wide variety of physical dimensions and shapes of the strips are considered within the scope of the present invention.

Pairs of Strips Working Together

Figure 9:
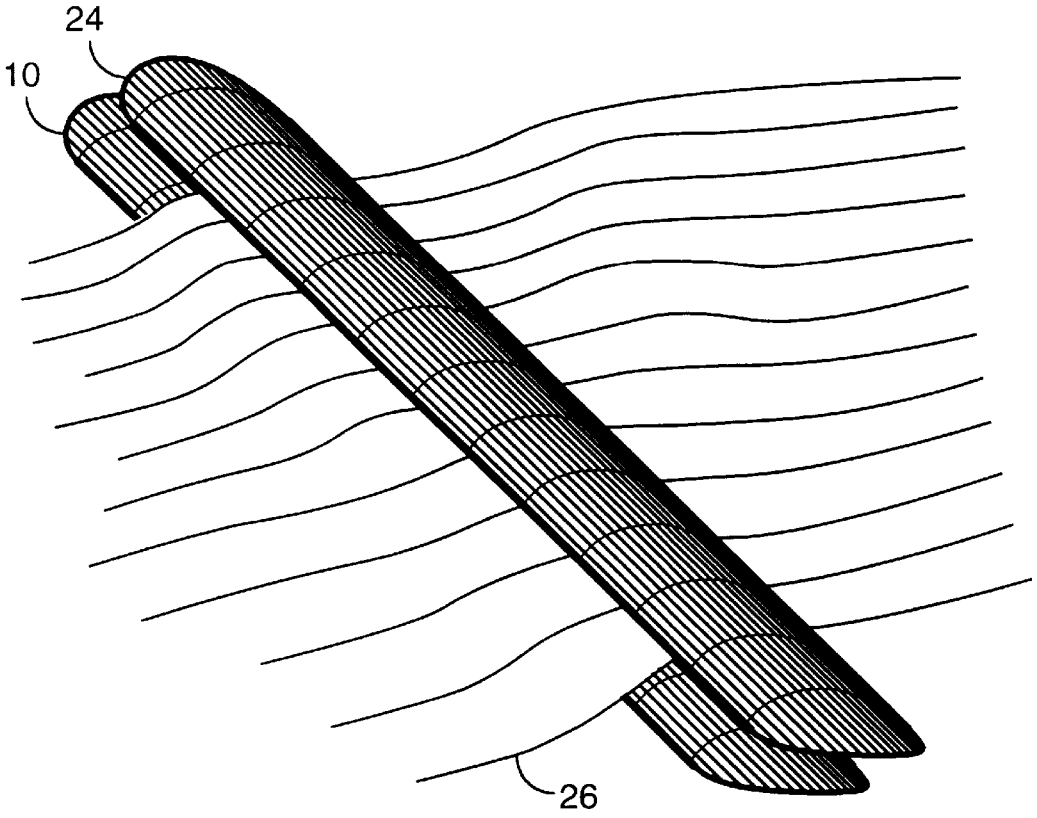
FIG. 9 is a perspective view of hair positioned between a pair of strips in an open state, according to the present invention.
Figure 10A:
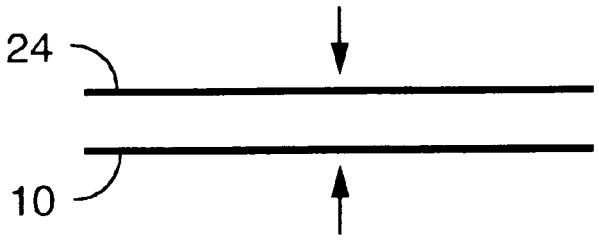
FIGS. 10A–10D illustrate successive steps during double coiling of a pair of strips, according to the present invention.
Figure 10B:
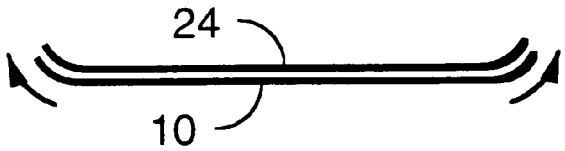
Figure 10C:
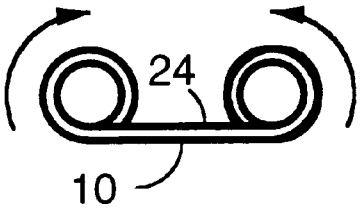
Figure 10D:
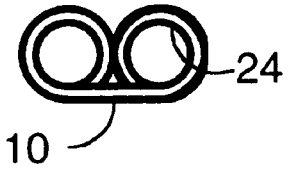

In general, the article of the invention comprises at least one spring strip 10, and a second strip of material 24 for securing the hair 26 against the spring strip 10 while it is in the open state, as shown in FIG. 9. In the preferred embodiment of the invention, the second strip 24 is a second spring strip. In this particularly advantageous embodiment of the invention, the two strips are of equal, or nearly equal size, and one naturally nests within the other when they are aligned. As shown in FIGS. 10A–10D, when the two strips are placed together (FIG. 10A) and 'snapped' out of their open positions (FIG. 10B) , they coil up together (FIG. 10C) to their double coiled, closed positions (FIG. 10D) . In this mutually coiled state, the two spring strips are tightly secured against each other. This synergistic property of two strips allows them to securely hold hair 26 that was placed between them prior to coiling.

In addition to simply holding the hair, the coiling action of the strips also serves to dynamically style the hair at the same time. Two examples of this highly advantageous property of the present invention are illustrated in FIGS. 11A–11C. In FIG. 11A is shown the placement of the hair 26 between the two open strips 10 and 24. When the strips are snapped out of their open states, they release their potential energy and coil up, coiling the hair with them. If strips 10 and 24 are oriented so that they coil away from the head, the style shown in FIG. 11B results. This hair style is similar to a ponytail, but provides a more styled look. Alternatively, if strips 10 and 24 are oriented so that they coil toward the head rather than away from the head, the hair style shown in FIG. 11C results. For persons with thin hair, this style has the advantage that it provides the appearance of a fuller ponytail with more hair volume.

It will be appreciated that two spring strips are not necessary to practice the present invention. Another embodiment of the invention, shown in FIGS. 19A–19B, comprises one spring strip 10 together with a non-springed strip 24 of flexible material to hold the hair against the spring strip. When the spring strip 10 coils into the closed position, the hair 26 is held and styled just as in the case of two springed strips. The flexible material may be composed of various materials such as a natural or synthetic fabric, a plastic, rubber, or elastic cord, a metal, or some combination thereof. It will be understood that these materials are simply examples and that any material is suitable provided that it both serves to hold the hair against the open spring strip and is capable of coiling up with the spring strip. With this in mind, it will be appreciated that many of the features described herein in relation to the second spring strip 24 pertain equally to any non-springed strip.

Attachment of Two Strips

Figure 12A:
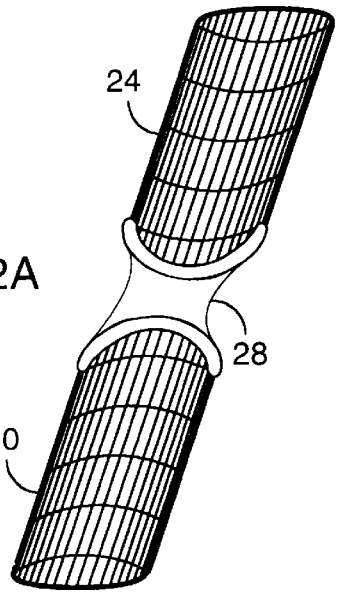
FIGS. 12A–12B are perspective views of a pair of attached strips, according to the present invention.
Figure 12B:
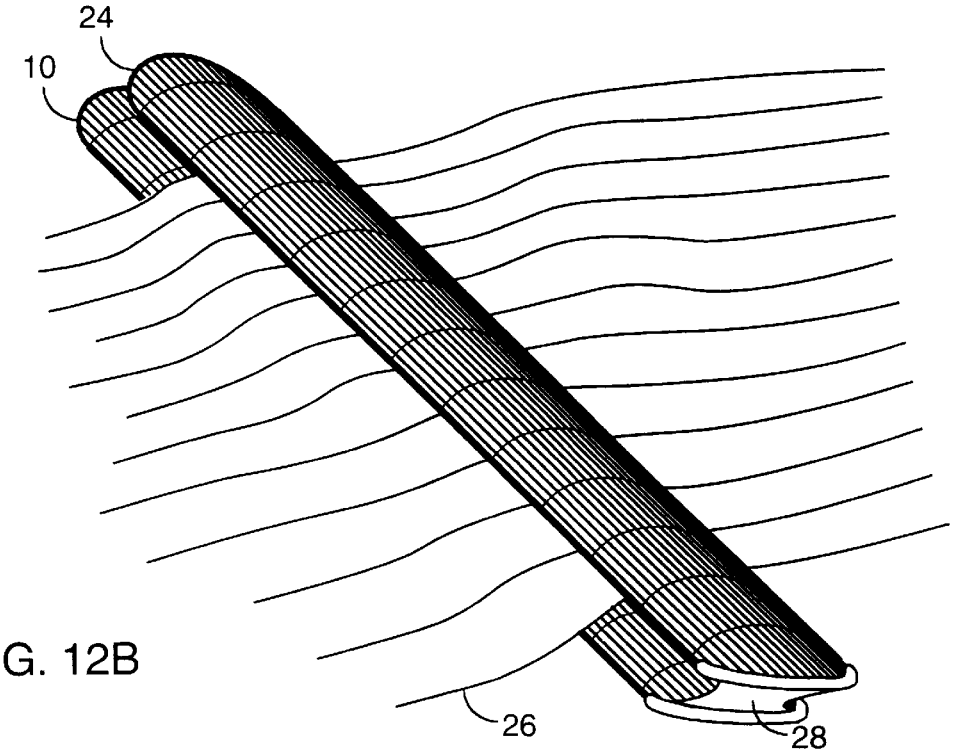

In the preferred embodiment of the invention, the two spring strips 10 and 24 are flexibly attached to each other by an attachment member 28, as shown in FIGS. 12A and 12B. The attachment member 28 flexibly joins an end of the first spring strip to an end of the second spring strip. The attachment member serves to prevent the two strips from becoming separated while the strips are open and not in use, as shown in FIG. 12A. It also assists in retaining the open strips in alignment when hair 26 is being placed and positioned between them prior to coiling, as shown in FIG. 12B. The attachment member is flexible either by virtue of being composed of a flexible material, or by virtue of being a type of hinge or similar element. In the preferred embodiment, the attachment member is a flexible material such as rubber, soft plastic, polyester, krayton, or other similar material.

It will be appreciated that the attachment member is not necessary to practice the present invention. Indeed, the invention in its simplest manifestation comprises two unattached strips that are manually aligned during use, as shown in FIG. 9. This embodiment of the invention allows either of the strips to be easily exchanged for another, so that a given pair of strips need not always be used together.

The strips may be easily used in two distinct configurations: one with the first strip 10 on the inside when coiled, the other with the first strip 10 on the outside when coiled. Although these configurations are functionally identical in the case of two spring strips, if the strips are differently ornamented, these two configurations provide more variety of appearance to the user. It should be noted that such configurational changes are not limited to non-attached strips since attachment members that allow 360 degree changes in relative orientation of the strips permit such changes of configuration.

Coatings, Wrappings and Tread

Figure 13A:
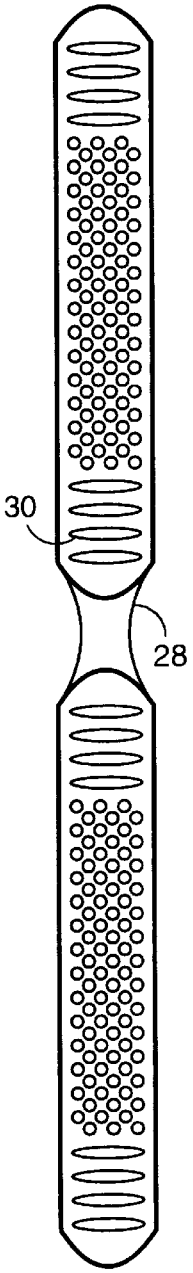
FIGS. 13A–13B are top and side views, respectively, of a pair of attached strips coated with a textured coating, according to the present invention.
Figure 13B:
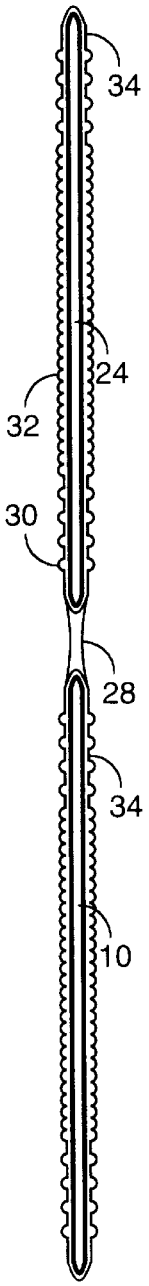

In the preferred embodiment of the invention, the strips both have an exterior coating or wrapping that serves to enhance the capability of the two strips to grip the hair positioned between them. In addition to this functional purpose, the coating or wrapping often also may serve an ornamental or aesthetic purpose. The functional properties of the coating or wrapping typically derive from its material composition and/or its surface topography. Preferably, the surface topography of the coated or wrapped strips is such that it provides some degree of resistance to the movement of hair through the pair of strips. For example, FIGS. 13A and 13B show a top view and a side view, respectively, of an embodiment of the invention wherein each of the two strips 10 and 24 has an exterior coating 34 with a "tread" or "texture" pattern on both sides of the strip. The pattern comprises a series of protruding ridges 30 and bumps 32 in the surface. It will be appreciated that a texture may be present on just one side of each strip, rather than on both sides. The coating may be composed of any of various different materials such as plastic resin materials, polyesters, synthetic rubber, kragton, foam or other synthetic or natural material. A coating may be applied to the strip using appropriate techniques. For example, an injection molding process may be used to apply a plastic resin or polyester coating to the strip. A compression molding process may be used to apply a synthetic rubber coating, and a room temperature curing process may be used to apply a foam coating. The strip may also be rubber coated with a vulcanizing process, or vinyl coated by a dipping process. In the case where an attachment member 28 is used together with a coating, the two are preferably composed of compatible materials and a single process is used to both create the coating and attach the two strips together.

Figure 14A:
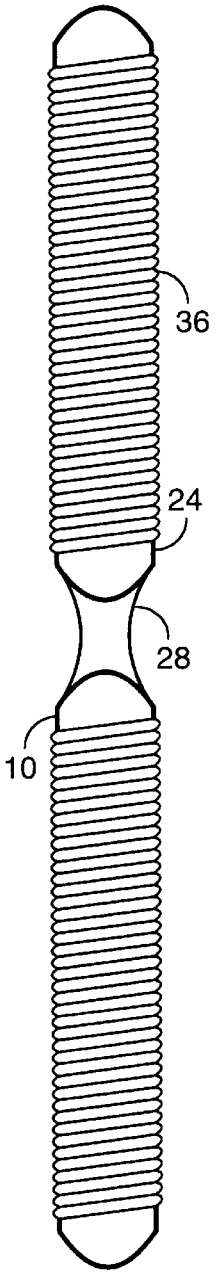
FIGS. 14A–14B are top and side views, respectively, of a pair of attached strips wrapped with a string, according to the present invention.
Figure 14B:
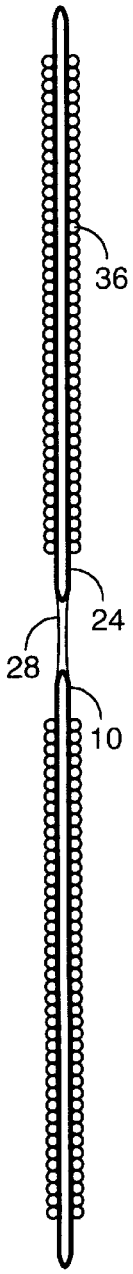

The strips may also be decoratively painted, foil printed, or covered with adhesively bound fabric, cord, string or thread. For example, FIGS. 14A and 14B show top and side views, respectively, of an embodiment of the invention wherein each of the two strips 10 and 24 has been wrapped with a string 36. Beads or other small decorative objects may be part of the wrapping or imbedded in the coating, thereby providing cosmetic enhancement and/or functional topographical features.

It will be appreciated that the coating or wrapping of the strips is not a necessary component of the present invention. By its very nature, the coiled spring strip can hold hair well without any coating or wrapping, especially in the case of strips composed of certain materials having inherently high surface friction. In addition, it will be noted that the topographical features may be provided without the application of an additional coating or wrapping to the strip. For example, a strip may be manufactured to have inherent topographical surface features, produced by any known techniques such as stamping, embossing, injection molding and any secondary operations. Such a strip may be composed of plastic or vinyl, for example.

Using the Spring Strip Hair Clip

Embodiments of the present invention may be used to create a wide variety of hair styles. As already discussed above in relation to FIGS. 11A–C, an embodiment of the present invention may be used to create the two different hair styles shown in FIGS. 11B and 11C. The method of styling the hair in these cases includes placing the hair 26 between strips 10 and 24 as shown in FIG. 11A, then releasing the potential energy of the strips so that they form a double coil (FIG. 7). A different style will be created depending on whether the strips have been oriented so that they coil toward or away from the head. Preferably, when the hair is placed between the strips as shown in FIG. 11A, it is evenly distributed across the length of the strips. Generally, if the hair is thicker or if a larger portion of the total amount of hair is to be styled, a larger pair of strips and/or stronger spring force is preferred. For thinner hair or for styling small portions of hair, smaller strips and/or weaker spring force is preferred. For the strongest spring force, spring strips made of spring steel are preferred.

The great versatility of the present invention will now be illustrated through the following examples of easy hair styles which may be created using embodiments of the present invention. It will be appreciated that these examples are just a few of the many possible hair styles that may be created using the hair styling article of the present invention.

Figure 15A:
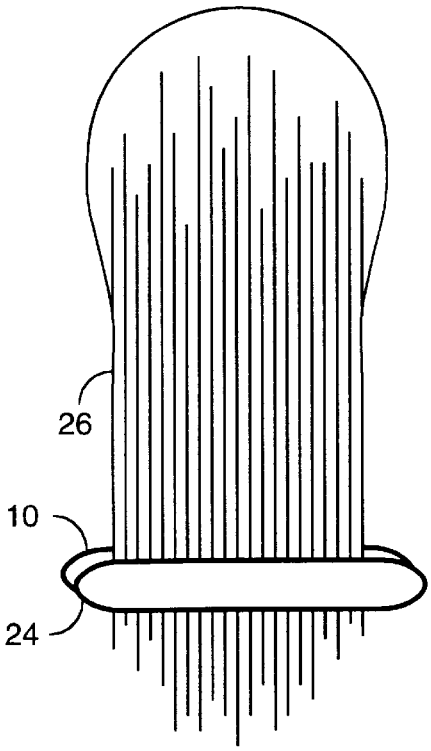
FIGS. 15A–15C illustrate successive steps of creating a "bun" hair style, according to the present invention.
Figure 15B:
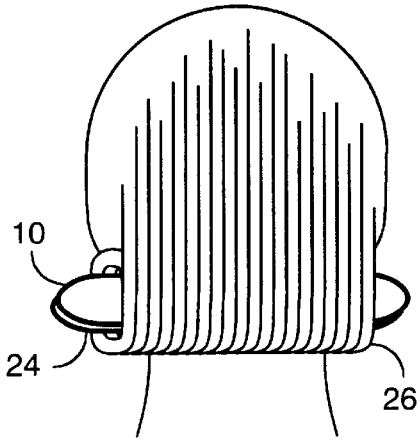
Figure 15C:
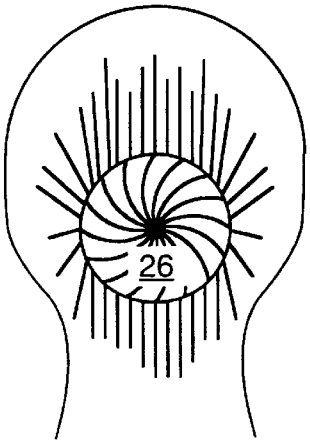

FIGS. 15A–C illustrate how a hair bun may be made. First, the hair 26 is placed between two strips 10 and 24, as shown in FIG. 15A. Instead of placing the strips near the middle of the strands of hair, as is done in FIG. 11A, the strips in this case are positioned near the ends of the strands of hair. The length of hair is then rolled around the strips by turning the strips around their longitudinal axes toward the body. The result of this rolling is shown in FIG. 15B. The strips are then released from their open state. As they coil into their closed state (FIG. 3), the hair 26 is wrapped into a bun, as shown in FIG. 15C.

Figure 16A:
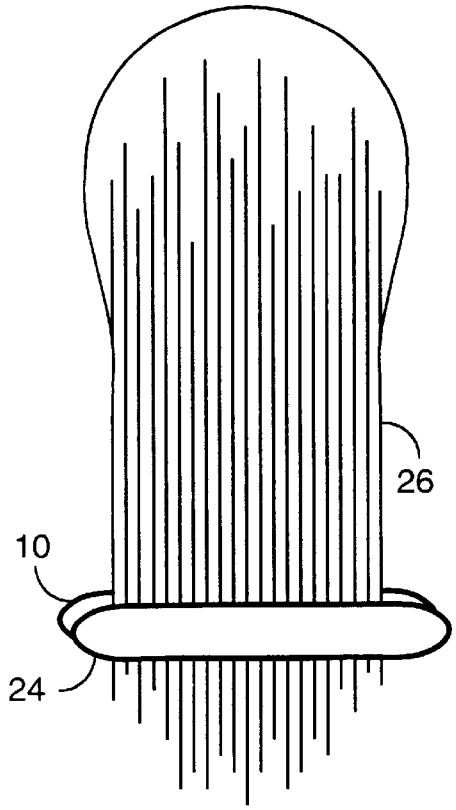
FIGS. 16A–16C illustrate successive steps of creating an up-do hair style, according to the present invention.
Figure 16B:
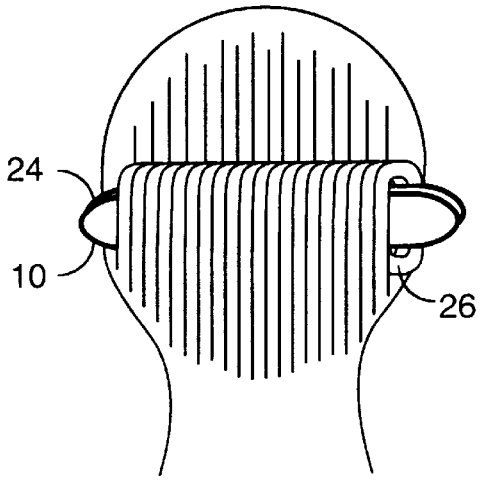
Figure 16C:
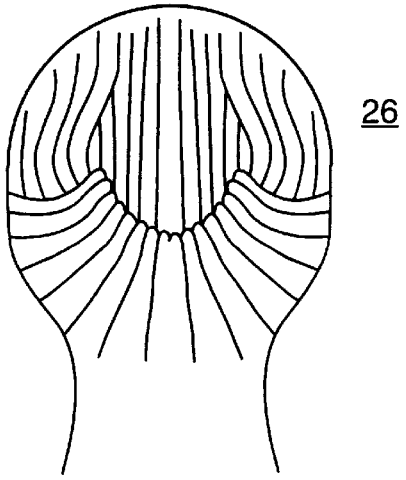

FIGS. 16A–C illustrate the creation of another hair style. As with the bun just described above in relation to FIGS. 15A–C, the hair 26 is positioned between the two strips 10 and 24 near the ends of the strands of hair, as shown in FIG. 16A. The hair is then rolled around the pair of strips by turning the strips around their longitudinal axes away from the body. The result is shown in FIG. 16B. The strips are then released from their open state and allowed to partly coil. The ends of the strips are tucked into the hair on the back of the head, rather than allowing the ends to coil completely, resulting in the style as shown in FIG. 16C.

FIGS. 17A–C illustrate a style created using several smaller pairs of strips. A top layer 37 of hair is placed between a first pair 38 of smaller strips, as shown in FIG. 17A. The hair is then rolled around the strips, which are then released to their closed states to create a small bun 40, as shown in FIG. 17B. A second layer 42 of hair is then placed between a second pair 44 of smaller strips, and a second bun 46 is made in a similar manner. The process is then repeated for successive layers of hair, creating a series of small buns, as shown in FIG. 17C.

FIGS. 18A–C illustrate a style created using a small pair of strips and a regular sized pair of strips. First, a top layer of hair 48 is placed between a first pair 50 of smaller strips, as shown in FIG. 18A. Just as in the previous style, the hair is then rolled and the strips are closed to create a small bun 52, as shown in FIG. 18B. The remaining hair 54 is then placed between a pair 56 of regular sized strips and rolled up around the strips as if creating a second bun. When the regular sized strips are released from their open state, however, they are guided to coil the rolled hair 54 around the smaller bun 52, resulting in the hair style shown in FIG. 18C.

As the above examples illustrate, the article of the present invention may be used to create a wide variety of unique and attractive hair styles. It will be appreciated that many other hair styles may be created with the article of the present invention through variations on the techniques illustrated above, as well as through other techniques. For example, small pairs of strips can be used to create a collection of miniature buns arranged in a sequence from ear to ear across the crown of the head, arranged in a cluster in the back of the head, or arranged in various other ways. In another example, two pairs of strips can be used to create a bun around a ponytail. The variety of possible styles is virtually limitless. It will also be appreciated that the present invention may be used in conjunction with various other hair styling articles such as clips, pins, barrettes, elastic bands, and the like. It is important to note also that the invention may be used with wigs and with doll hair, as well as with real human hair.

It will be clear to one skilled in the art that the above embodiment may be altered in many ways without departing from the scope of the invention. Accordingly, the scope of the invention should be determined by the following claims and their legal equivalents.

What is claimed is:

1. A hair styling article comprising:

a first strip having an open state of high energy and a closed state of low energy, wherein the open state corresponds to a linear shape of the first strip and the closed state corresponds to a coiled shape of the first strip, wherein the open state is a stable equilibrium state, and wherein the first strip in the open state has a curvature around a longitudinal axis;

a second strip, wherein the second strip is flexible and is approximately equal in length to the first strip; and a flexible attachment member connecting an end of the first strip to an end of the second strip;

wherein hair can be placed between first strip and the second strip;

whereby hair may be styled by placing the hair between the first and second strips when the first strip is in the open state, then coiling the strips so that the first strip is in the closed state.

2. The article of claim 1 wherein the first strip is a strip of carbon spring steel.

3. The article of claim 1 wherein the first strip is a strip of memory plastic.

4. The article of claim 1 wherein the second strip has a second strip open state of high energy and a second strip closed state of low energy, wherein the second strip open state corresponds to a linear shape of the second strip and the second strip closed state corresponds to a coiled shape of the second strip.

5. The article of claim 1 wherein the first and second strips are strips of carbon spring steel.

6. The article of claim 1 wherein the first and second strips are strips of memory plastic.

7. The article of claim 1 wherein the first and second strips comprise a coating.

8. The article of claim 7 wherein the coating has a textured surface.

9. The article of claim 7 wherein the coating comprises small imbedded objects.

10. A method for styling hair comprising:

placing a portion of the hair between a first strip and a second strip, wherein the second strip is flexible and is approximately equal in length to the first strip, and wherein the first strip is in an open state of high energy stable equilibrium corresponding to a linear shape of the first strip, wherein the first strip in the open state has a curvature around a longitudinal axis; and coiling the first and second strips, such that the first strip releases energy and enters a low energy state corresponding to a coiled shape of the first strip;

whereby the hair is coiled and styled.

11. The method of claim 10 wherein the first strip is a strip of carbon spring steel.

12. The method of claim 10 wherein the first strip is a strip of memory plastic.

13. The method of claim 10 wherein the first and second strips are strips of carbon spring steel.

14. The method of claim 10 wherein the first and second strips are strips of memory plastic.

15. The method of claim 10 wherein the second strip comprises an elastic cord.

16. A hair styling article comprising:

a pair of carbon spring steel strips, wherein each spring steel strip has an open state and a closed state, wherein each strip in the open state has a linear shape along a longitudinal axis and a curvature around the longitudinal axis, wherein the open state is a stable equilibrium state of high energy and the closed state is a state of low energy;

wherein the strips comprise a material coating having a tread pattern;

wherein hair can be placed between the pair of carbon spring steel strips;

whereby hair may be styled by placing the hair between the strips, then coiling the strips.

17. The article of claim 16 further comprising an attachment member flexibly connecting the pair of strips to each other.

18. A hair styling article comprising:

a carbon spring steel strip having an open state and a closed state, wherein the strip in the open state has a linear shape along a longitudinal axis and a curvature around the longitudinal axis, wherein the open state is a stable equilibrium state of high energy and the closed state is a state of low energy; and an elastic strip attached to ends of the carbon steel strip, such that the elastic strip and the spring steel strip are retained in alignment;

wherein hair can be placed between the carbon spring steel strip and the elastic strip;

whereby hair may be styled by placing the hair between the strips, then coiling the strips.

* * * * *